US011433400B2

(12) United States Patent
Convery

(10) Patent No.: US 11,433,400 B2
(45) Date of Patent: Sep. 6, 2022

(54) METHOD AND APPARATUS FOR WASHING AND GRADING SAND

(71) Applicant: CDE Global Limited, Cookstown (GB)

(72) Inventor: Anthony Convery, Moneymore (GB)

(73) Assignee: CDE Global Limited, Cookstown (GB)

( * ) Notice: Subject to any disclaimer, the term of this patent is extended or adjusted under 35 U.S.C. 154(b) by 0 days.

(21) Appl. No.: 16/952,297

(22) Filed: Nov. 19, 2020

(65) Prior Publication Data

US 2021/0146376 A1 May 20, 2021

(30) Foreign Application Priority Data

Nov. 19, 2019 (GB) ..... 1916814

(51) Int. Cl.

| | |
|---|---|
| ***B03B 9/00*** | (2006.01) |
| ***B03B 5/34*** | (2006.01) |
| *B07B 1/28* | (2006.01) |
| *B07B 13/16* | (2006.01) |

(52) U.S. Cl.

CPC ..... *B03B 9/00* (2013.01); *B03B 5/34* (2013.01); *B07B 1/28* (2013.01); *B07B 13/16* (2013.01); *B07B 2230/01* (2013.01)

(58) Field of Classification Search

CPC ..... B03B 5/34; B03B 9/00; B07B 1/005

See application file for complete search history.

(56) References Cited

U.S. PATENT DOCUMENTS

| | | | | |
|---|---|---|---|---|
| 4,267,980 A * | 5/1981 | LaPoint | B03B 11/00 209/172.5 |
| 4,282,088 A * | 8/1981 | Ennis | B03B 5/36 209/172.5 |
| 9,744,537 B2 | 8/2017 | Convery et al. | |
| 10,189,028 B2 | 1/2019 | Convery | |
| 10,272,443 B2 | 4/2019 | Ivanoff | |
| 10,799,880 B2 | 10/2020 | McKeown | |

(Continued)

FOREIGN PATENT DOCUMENTS

| | | | |
|---|---|---|---|
| AU | 738103 B2 * | 6/1996 | B03B 9/06 |
| AU | 738103 B2 * | 9/2001 | B03B 9/06 |
| AU | 2009100586 A4 * | 7/2009 | B01D 21/245 |

(Continued)

OTHER PUBLICATIONS

UK Search Report of corresponding Application No. GB1916814.5, dated May 11, 2020.

*Primary Examiner* — Terrell H Matthews

(74) *Attorney, Agent, or Firm* — Gardner, Linn, Burkhart & Ondersma LLP

(57) ABSTRACT

A method and apparatus for washing and grading sand includes a first grading screen adapted to separate a feed material into a fine fraction and a coarse fraction, the coarse fraction having a greater particle size than the fine fraction. A first fines separation stage including one or more hydrocyclones is adapted to receive the fine fraction entrained in water, downstream of the first grading screen to thereby remove fine contaminants. A first dewatering screen includes a deck adapted to dewater the fine fraction downstream of the first fines separation stage to provide a fine sand product, and a second dewatering screen includes a deck adapted to dewater the coarse fraction downstream of the first grading screen to provide a coarse sand product.

20 Claims, 4 Drawing Sheets

(56) References Cited

U.S. PATENT DOCUMENTS

| | | | | |
|---|---|---|---|---|
| 2012/0267287 | A1* | 10/2012 | Bailey | B07B 1/4609 137/544 |
| 2019/0351429 | A1 | 11/2019 | Ivanoff | |

FOREIGN PATENT DOCUMENTS

| | | | | | |
|---|---|---|---|---|---|
| GB | 2546491 | A | * | 7/2017 | B03B 5/00 |
| GB | 2560038 | | | 8/2018 | |
| GB | 2583460 | A | * | 11/2020 | B03B 11/00 |
| KR | 20150133624 | A | * | 11/2015 | |
| KR | 20150133624 | A | * | 11/2015 | B03B 7/00 |
| WO | WO-2004009200 | A2 | * | 1/2004 | B03B 5/34 |
| WO | WO-2010144939 | A1 | * | 12/2010 | B01D 21/245 |
| WO | 2020002977 | | | 1/2020 | |
| WO | WO-2020002977 | A1 | * | 1/2020 | B03B 5/34 |
| WO | WO-2020065678 | A1 | * | 4/2020 | |

* cited by examiner

METHOD AND APPARATUS FOR WASHING AND GRADING SAND

CROSS REFERENCE TO RELATED APPLICATION

The present application claims priority benefit of U.K. Pat. Application Ser. No. 1916814.5, filed Nov. 19, 2019, which is hereby incorporated herein by reference in its entirety.

FIELD OF THE INVENTION

This invention relates to a method and apparatus for washing and grading sand, and in particular, to a method and apparatus for washing and grading coarse sand for use in the manufacture of concrete.

BACKGROUND OF THE INVENTION

Aggregate is a broad category of coarse particulate material used in construction, such term encompassing sand, gravel and crushed stone. The term "sand" typically covers aggregate having a grain sand of between 0.075 mm and 4.75 mm while the term "gravel" typically covers aggregate having a grain size of between 4.75 mm and 76.2 mm. Aggregates, in particular sands, are typically washed and graded on a combination of vibrating screens, to grade and dewater material, and hydrocyclones, to remove fine contaminants, to produce washed aggregate products having a predetermined grain size or range of grain size.

A typical vibrating screen comprises a frame, defined by a pair of substantially parallel side walls interconnected by transversely extending bridging members, upon which is mounted a polyurethane deck having small openings or slots for water and undersize particles to pass through. The frame is typically mounted on a base via resilient linkages and the frame, and thus the deck, is typically vibrated by means of a pair of counter rotating rotors defining eccentric masses, driven by one or more drive motors, to impart circular or reciprocating vibrating motion to the deck. Such screens can be used for washing and grading and/or dewatering aggregate, oversize material passing over the deck of the screen to be collected from a downstream end of the screen while water and undersize material is collected in a sump of the screen for subsequent processing.

A hydrocyclone is a device used to separate particles in a liquid suspension based on the ratio of their centripetal force to fluid resistance, facilitating the separation and removal of fine contamination from aggregates, sand in particular. A hydrocyclone typically comprises a cylindrical section having an inlet for supplying a feed slurry into the hydrocyclone tangentially, and a conical base. Outlets are provided at upper and lower ends of the hydrocyclone. Underflow, containing the coarser fraction (typically a sand product), passes out of the lower outlet while overflow, containing the finer fraction (typically fine contaminants, such as clay and silt) and most of the water, passes out of the outlet at the upper end of the hydrocyclone.

A coarser specification of sand is required to manufacture concrete in the US market when compared to that normally required for the European market. The American Society for Testing and Materials (ASTM) specifies a specific grade of sand for use in concrete products. This specification is referred to as C33. This coarse sand is typically in the grain size range of 2 mm to 8 mm. The larger particle size of the C33 sand compared to the sand products typically used for concrete production in Europe exacerbates wear with regards to hydrocyclones used to classify the sand and remove silt, increasing downtime and maintenance costs for the customer. In the US, sand having a grain size less than 2 mm is typically used as masonry sand rather than for concrete production.

SUMMARY OF THE INVENTION

According to a first aspect of the present invention there is provided a method of washing and grading sand comprising the steps of separating a feed material into a fine fraction and a coarse fraction, the coarse fraction having a greater particle size than the fine fraction, passing the fine fraction entrained in water to a first fines separation stage, comprising one or more hydrocyclones, to thereby remove fine contaminants therefrom before passing the fine fraction, carried in the under flow from the one or more hydrocyclones, to a first dewatering screen to be dewatered thereon and collected as a fine sand product, and passing the coarse fraction to a second dewatering screen to be dewatered thereon and collected as a coarse sand product.

Optionally, at least a portion of the fine fraction downstream of the first dewatering screen is added to the coarse sand product. At least a portion of the fine fraction downstream of the first dewatering screen may be collected as a fine sand product.

Optionally, the feed material is separated into the fine fraction and the coarse fraction on a first grading screen. In one embodiment, the first grading screen may comprise an inclined deck comprising a first deck portion having apertures of a first size through which the fine fraction of the feed material, entrained in water, passes to be collected in a first sump region and a second deck portion, downstream of the first deck portion, through which the coarse fraction of the feed material, entrained in water, passes to be collected in a second sump region, wherein oversize waste material passes over the first and second deck portions and is discharged from a distal end of the deck of the first grading screen.

The fine fraction may be passed through a further dewatering screen downstream of the first fines separation stage, the further dewatering screen having a deck with an aperture size selected such that the fine fraction passes through the deck and is collected in a sump of the further dewatering screen. Oversize material passing over the deck of the further dewatering screen is added to the coarse sand product. Undersize material collected in the sump of the further dewatering screen, comprising the fine fraction, may be passed, entrained in water, through a second fines separation stage, comprising one or more further hydrocyclones, before being passed onto the first dewatering screen.

In one embodiment the first and second dewatering screens may comprise first and second sides of a laterally divided split deck dewatering screen. The fine fraction of the feed material may be supplied to a sump of the split deck dewatering screen before being pumped, entrained in water, to the first fines separation stage. A portion of the fine fraction from the first side of the split deck watering screen may be added to the coarse sand product downstream of the split deck dewatering screen. The fine and coarse fractions may be delivered from the respective first and second sides of the split deck dewatering screen onto a conveyor assembly comprising first and second conveyors being mounted adjacent the split deck dewatering screen for receiving material from a discharge end of respective sides thereof, the conveyor assembly being displaced along an axis extending transverse to the deck of the split deck dewatering screen to vary the proportion of material falling from each of the first and second sides of the split deck dewatering screen onto each of the first and second conveyors to thereby vary the amount of the fine fraction added to the coarse fraction to form the coarse sand product. The first conveyor may collect a fine sand product from the first side of the split deck dewatering screen.

In one embodiment, the fine fraction may comprise sand having a particle size up to approximately 2 mm and the coarse fraction may comprise sand having a particle size greater than approximately 2 mm.

According to a further aspect of the present invention there is provided an apparatus for washing and grading sand comprising a first grading screen adapted to separate a feed material into a fine fraction and a coarse fraction, the coarse fraction having a greater particle size than the fine fraction, a first fines separation stage, comprising one or more hydrocyclones, adapted to receive the fine fraction entrained in water, downstream of the first grading screen to thereby remove fine contaminants, a first dewatering screen having a deck adapted to dewater the fine fraction downstream of the first fines separation stage to provide a fine sand product, and a second dewatering screen having a deck adapted to dewater the coarse fraction downstream of the first grading screen to provide a coarse sand product.

In one embodiment the first grading screen may comprise an inclined deck comprising a first deck portion having apertures of a first size through which the fine fraction of the feed material, entrained in water, can pass to be collected in a first sump region and a second deck portion, downstream of the first deck portion, through which the coarse fraction of the feed material, entrained in water, can pass to be collected in a second sump region, wherein oversize waste material can pass over the first and second deck portions to be discharged from a distal end of the deck of the first grading screen.

The apparatus may further comprising a further dewatering screen downstream of the first fines separation stage, the further dewatering screen having a deck with an aperture size selected such that the fine fraction passes through the deck to be collected in a sump therebeneath, wherein oversize material passing over the deck of the further dewatering screen is added to the coarse sand product. The sump of the further dewatering screen may include or be associated with a pump adapted to pump the fine fraction, entrained in water, to a second fines separation stage, comprising one or more further hydrocyclones, upstream of the first dewatering screen.

In another embodiment the first and second dewatering screens comprise first and second sides of a laterally divided split deck dewatering screen. The fine fraction of the feed material may be supplied to a sump of the split deck dewatering screen, the sump including or being associated with a pump adapted to pump the fine fraction, entrained in water, to the first fines separation stage. The fine and coarse fractions may be delivered from the respective first and second sides of the split deck dewatering screen onto a conveyor assembly comprising first and second conveyors mounted adjacent the split deck dewatering screen to receive material from a discharge end of respective sides thereof, the conveyor assembly being displaceable along an axis extending transverse to the deck of the split deck dewatering screen to vary the proportion of material falling from each of the first and second sides of the split deck dewatering screen onto each of the first and second conveyors to thereby vary the amount of the fine fraction added to the coarse fraction to form the coarse sand product. The first conveyor may be adapted to collect a fine sand product from the first side of the split deck dewatering screen.

The water and fine contamination overflowing from the upper ends of the hydrocyclones of the or each fines separation stages may be passed to a water treatment system to be treated and subsequently reused in the grading and/or dewatering screens. The water treatment system may comprise a settling tank wherein sludge is collected in a lower end of the settling tank for subsequent removal, treatment and disposal, water overflowing from the settling tank being collected in a water storage reservoir for subsequent reuse. The water treatment system may include a mixing and dosing apparatus adapted to add a flocculent to the waste water upstream of the settling tank.

These and other objects, advantages, purposes and features of the present invention will become apparent upon review of the following specification in conjunction with the drawings.

DETAILED DESCRIPTION OF THE DRAWINGS

Figure 1:
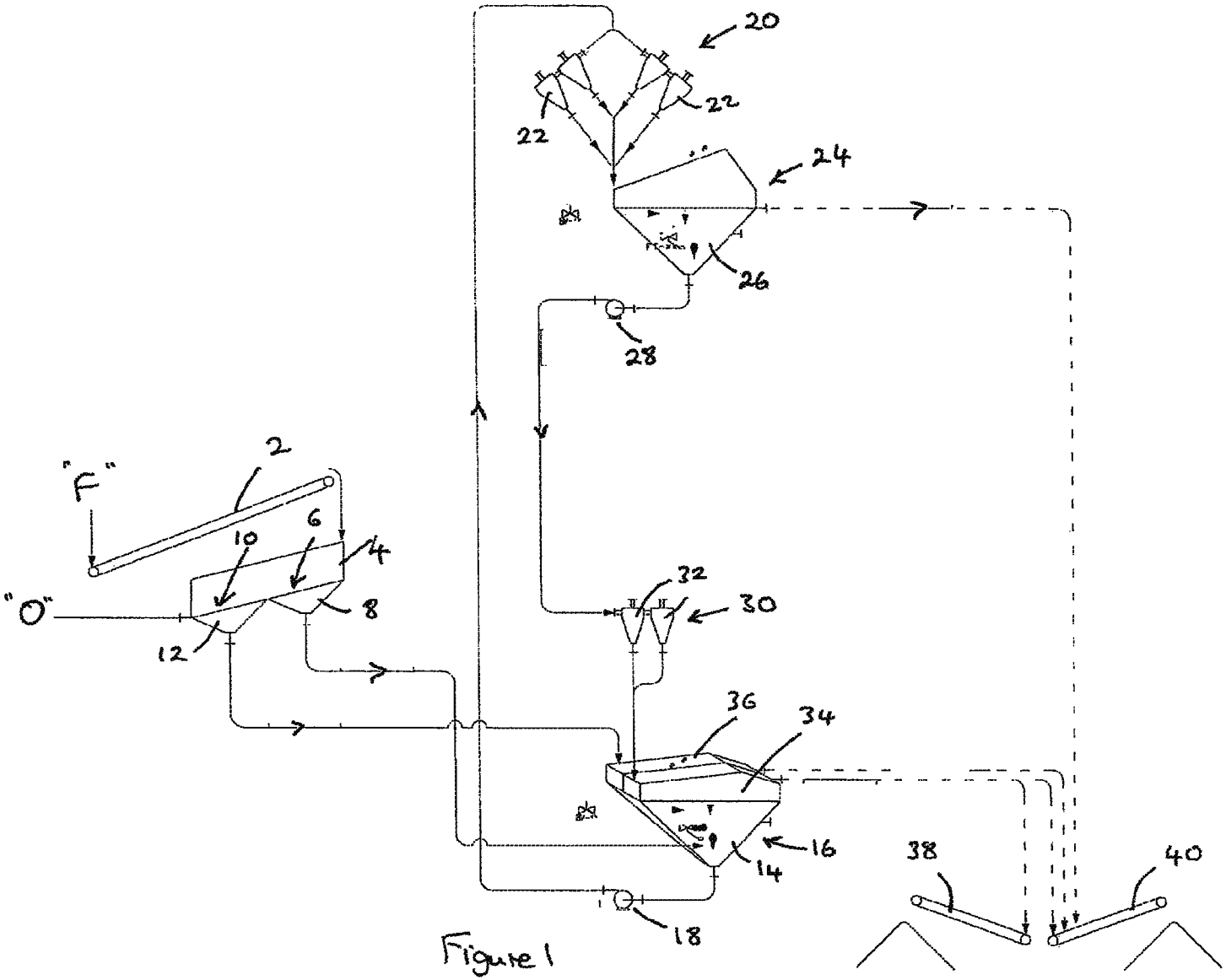
FIG. 1 is a schematic illustration of an apparatus for washing and grading sand in accordance with an embodiment of the present invention.
Figure 2:
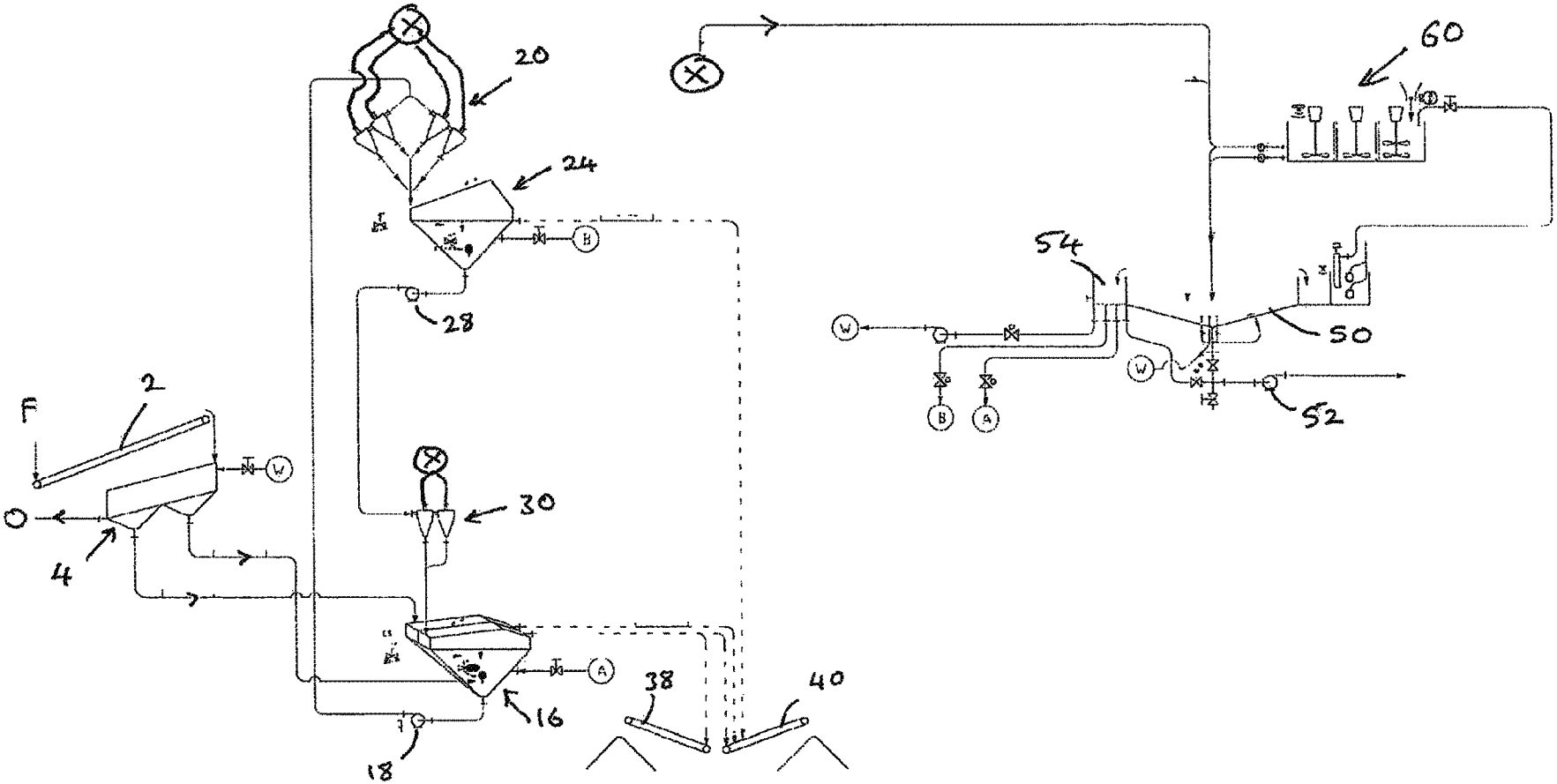
FIG. 2 is a schematic illustration of the sand washing and grading system of FIG. 1 with the addition of a water treatment and recycling system.
Figure 3:
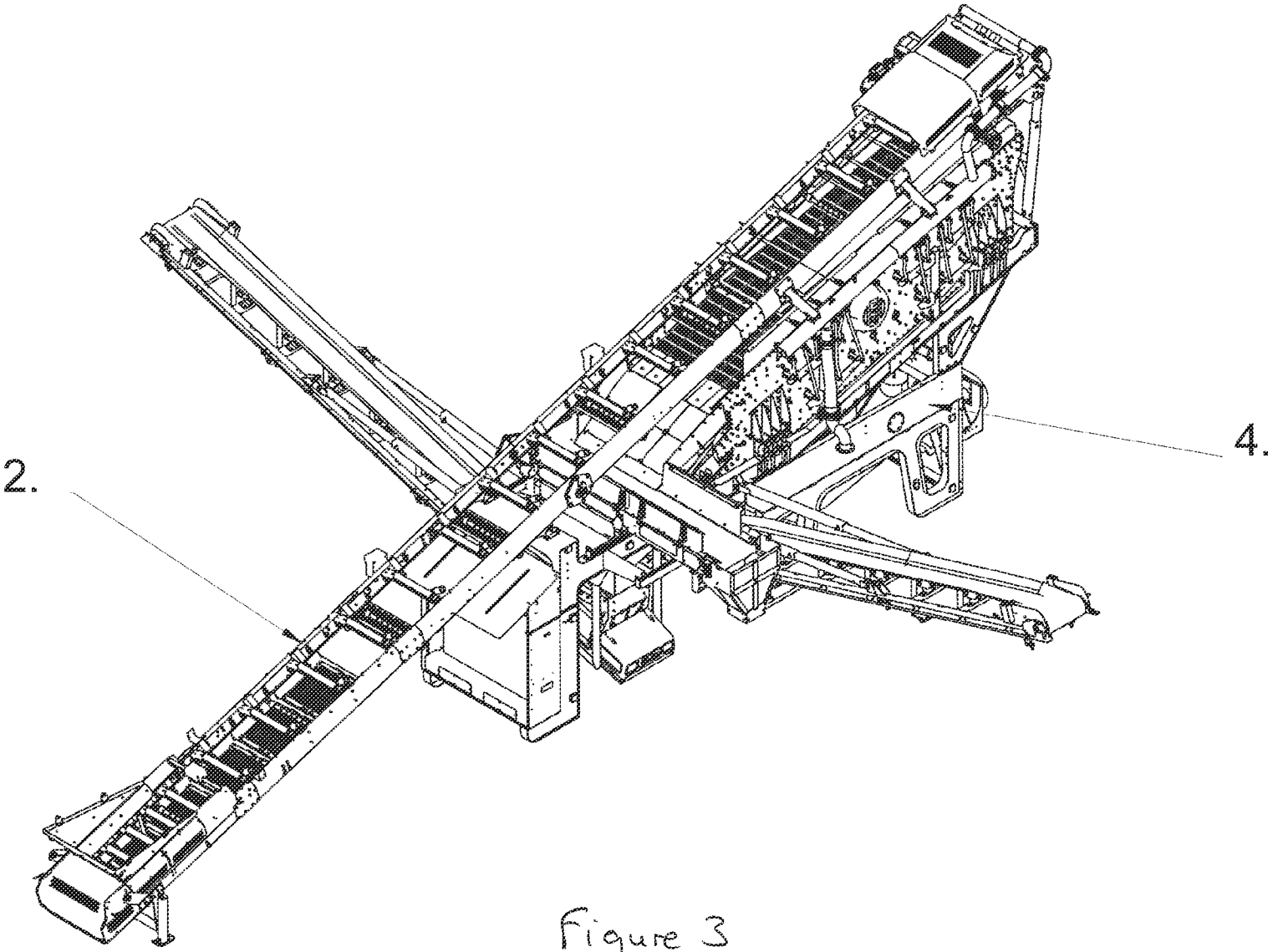
FIG. 3 is a perspective view of the first grading screen of the apparatus of FIG. 1.
Figure 4:
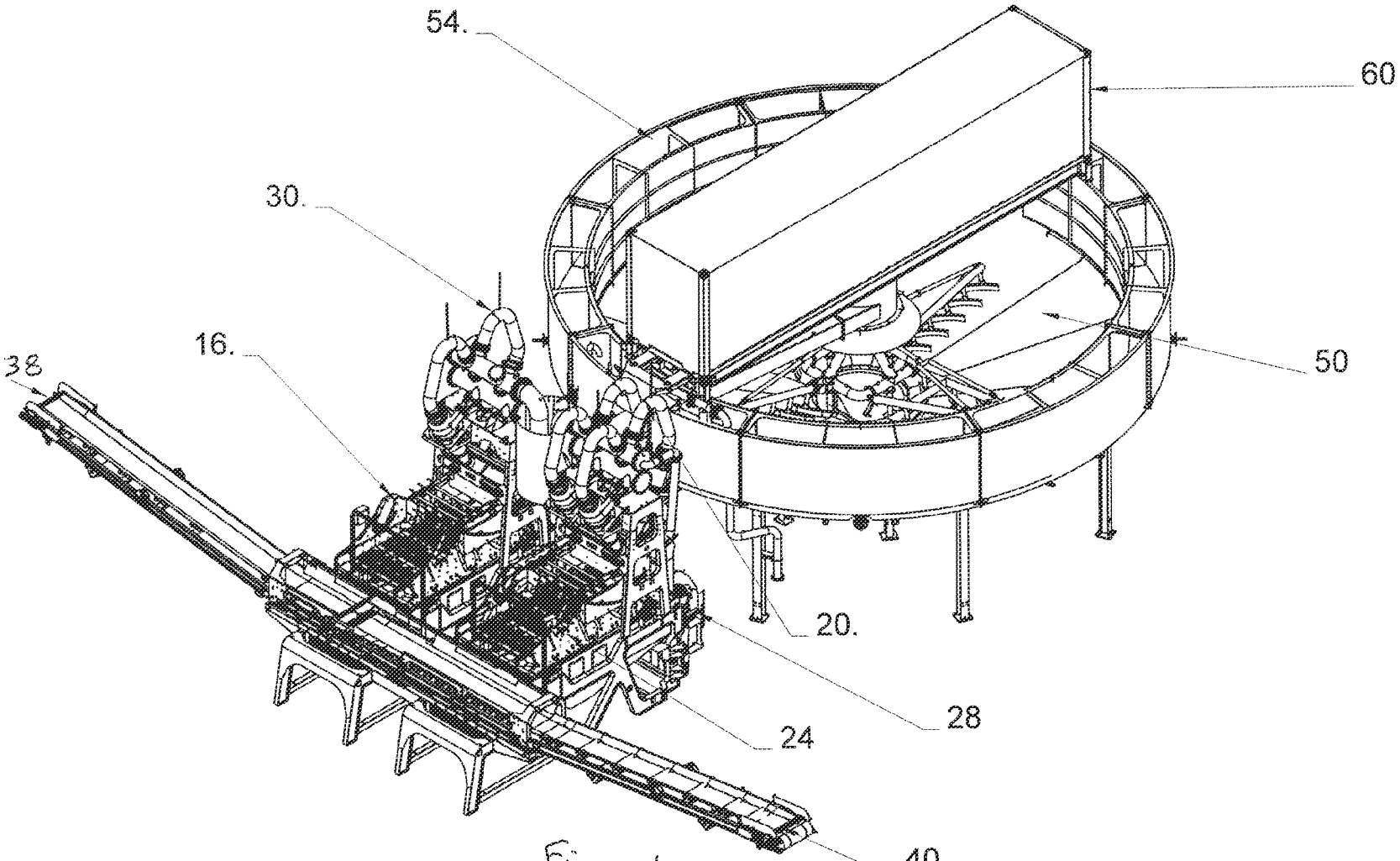
FIG. 4 is a perspective view of the remainder of the apparatus of FIG. 1.

An apparatus for washing and grading sand in accordance with an embodiment of the present invention, with particular application to the production of C33 grade coarse sand, is illustrated schematically in FIGS. 1 and 2. FIGS. 3 and 4 provide perspective views of components of one such actual apparatus.

A feed material "F" is delivered from a feed conveyor or pump 2 onto an upper end of an inclined deck of a first grading screen 4 adapted to separate the feed material, to which water is added, into a fine fraction and a coarse fraction. In the embodiment shown, the deck of the first grading screen 4 includes a first or upper deck portion 6 having apertures of a first size through which the fine fraction of the feed material, for example 0 mm to 2 mm particle size, can pass to be collected in a first sump region 8 beneath the first deck portion 6, and a second or lower deck portion 10, downstream of the first deck portion 6, through which the coarse fraction of the feed material, for example 2 mm to 8 mm particle size, can pass to be collected in a second sump region 12. Oversize waste material "O" can pass over the first and second deck portions 6, 10 of the first grading screen to be discharged from a distal end of the deck of the first grading screen for collection and further treatment and/or disposal.

The fine fraction collected in the first sump region 8 of the first grading screen 4 and entrained in water, is pumped to a sump 14 of a split deck dewatering screen 16 (or may flow under gravity to the sump 14) before being pumped, via a first slurry pump 18, to a first fines separation stage 20, including a plurality of hydrocyclones 22 arranged in parallel.

An underflow from the first fines separation stage 20, including the fine fraction from which some or all of fine contamination has been removed, is passed onto the deck of a primary dewatering screen 24 adapted to separate and dewater further coarse material from the fine fraction. For example, the deck of the primary dewatering screen may have an aperture size of 0.8 mm such that the fine fraction, comprising 0 mm to 0.8 mm sand, may pass through the deck while coarser material (typically 0.8 mm to 2 mm sand) is dewatered and passes over the deck. Such oversize coarse material may be added to the coarse fraction to define a coarse sand product, as will be described below. The undersize material, comprising the remainder of the fine fraction and water, is collected in a sump 26 of the primary dewatering screen 24 and is pumped, via a second slurry pump 28, to a second fines separation stage 30, including further one or more further hydrocyclones 32, for the removal of any remaining fine contamination from the fine fraction of the feed material. In the embodiment described above the deck of the primary dewatering screen 24 may have an aperture of approximately 0.8 mm, although this may be varied as required.

An underflow of the second fines separation stage 30, comprising the cleaned fine fraction (or example 0 mm to 0.8 mm sand), is passed onto a first side 34 of the split deck dewatering screen 16.

The coarse fraction from the second sump region 12 of the first grading screen 4 is passed onto a second side 36 of the split deck dewatering screen 16.

A fine sand product, for example having a particle size of 0 mm to 0.8 mm, is delivered from the first side 34 of the split deck dewatering screen 16 onto a first conveyor 38. Such fine sand product may be supplied to customers as masonry sand.

A coarse sand product, for example having a particle size of between 0.8 mm and 8 mm, is delivered from the second side 36 of the split deck dewatering screen 16 onto a second conveyor 40. Oversize material from the primary dewatering screen 24 is preferably also added to the coarse sand product on the second conveyor 40.

In one embodiment, a portion of the fine fraction from the first side 34 of the split deck dewatering screen 16 may be added to the second conveyor 40 to be blended with the coarse sand product, as required. This may be achieved by mounting the first and second conveyors 38,40, or at least a feed mechanism thereof, to be displaceable along an axis extending transverse to the deck of the split deck dewatering screen 16 to vary the proportion of material falling from each of the first and second sides 34,36 of the split deck dewatering screen 16 onto each of the first and second conveyors 38,40 to thereby vary the amount of the fine fraction added to the coarse fraction to form the coarse sand product.

The underflow that is washed through the deck apertures of the primary dewatering screen 24 is pumped through the second fines separation stage and discharged onto the first side 34 of the split deck dewatering screen 16 to produce a fine masonry sand. This masonry sand is then collected by the first conveyor 38 and stockpiled.

The two conveyors 38,40 can be moved in relation to the two sides 34,36 of the split deck dewatering screen 16, allowing for fine masonry sand to blended back into the C33 coarse concrete sand if the specification allows, helping to increase the amount of valuable product produced.

Water and fine contamination overflowing from the upper ends of the hydrocyclones 22,32 of the first and second fines separation stages 20,30 may be passed to a water treatment system, which may include a settling tank wherein sludge is collected in a lower end of the settling tank for subsequent removal, treatment and disposal, water overflowing from the settling tank being collected in a water storage reservoir and delivering water from the storage reservoir to be supplied to one or more of the first grading screen 4, primary dewatering screen 24 and split deck dewatering screen 16 (in particular to control the water content in the sump 14 thereof). The waste water may be dosed with a flocculent before being added to the settling tank.

FIG. 2 illustrates the combination of the sand washing and grading system of FIG. 1 with the addition of such a water treatment and recycling system. As discussed above, the overflow from the hydrocyclones 22,32 of the first and second fines separation stages 20,30 may be passed into a settling tank 50. A suitable flocculent may be added to waste water upstream of the settling tank 50 to facilitate the settling out of the sludge from the water via a mixing and dosing apparatus 60 upstream of the settling tank 50. FIG. 4 illustrates the water treatment and recycling system in more detail.

Sludge collected in the bottom of the settling tank 50 may be pumped for treatment and/or disposal, for example to a sludge pond, via a suitable pump 52, while water overflowing from the settling tank 50 is collected in a water storage reservoir 54, from which it may be recycled for use in the washing and grading processes.

A controller may be provided for controlling the addition of water to the water storage reservoir 54 from a separate water supply to maintain the water level within the water storage reservoir 54, if required.

In one embodiment the water storage reservoir 54 is arranged around the periphery of the settling tank 50. The settling tank 50 may have a double skinned outer wall such that the water storage reservoir 54 is defined between the double skins of the outer wall of the settling tank 50.

Note that the deck aperture sizes and sand particle sizes of the respective fine and coarse sand products quoted above can vary from project to project and the sizes quoted are used as an example only.

Main benefits of the above described embodiments of the present invention:

Only smaller material (for example 0 mm to 2 mm in the case of the first fines separation stage and 0 mm to 0.8 mm in the case of the second fines separation stage) is pumped through the hydrocyclones 22,32 of the first and second fines separation stages 24,30 and associated slurry pumps 18,28, reducing component wear, plant downtime, and hence cost of production for the customer.

The arrangement of the split deck dewatering screen 16 and first and second conveyors 38,40 facilitates adjustment and blending of the sand specification being produced.

The invention is not limited to the embodiments described herein but can be amended or modified without departing from the scope of the present invention, which is intended to be limited only by the scope of the appended claims as interpreted according to the principles of patent law including the doctrine of equivalents.

The invention claimed is:

1. A method of washing and grading sand comprising:

separating a feed material on a first grading screen into a fine fraction and a coarse fraction, the coarse fraction having a greater particle size than the fine fraction, the first grading screen comprising:

an inclined deck comprising a first deck portion having apertures of a first size through which the fine fraction of the feed material, entrained in water, passes to be collected in a first sump region; and a second deck portion, downstream of the first deck portion, through which the coarse fraction of the feed material, entrained in water, passes to be collected in a second sump region;

passing the fine fraction entrained in water to a first fines separation stage, comprising one or more hydrocyclones, to thereby remove fine contaminants therefrom before passing the fine fraction, carried in the under flow from the one or more hydrocyclones, to a first dewatering screen to be dewatered thereon and collected as the fine fraction;

passing the coarse fraction to a second dewatering screen to be dewatered thereon and collected as a coarse sand product;

passing oversize waste material over the first and second deck portions and discharging the oversize waste material from a distal end of the second deck portion of the first grading screen; and adding a portion of the fine fraction downstream of the first dewatering screen to the coarse sand product.

2. The method of claim 1, further comprising:

passing the fine fraction through a further dewatering screen downstream of the first fines separation stage, the further dewatering screen having a deck with an aperture size selected to separate further coarse material from the fine fraction;

passing the remaining fine fraction through the deck; and collecting the remaining fine fraction in a sump of the further dewatering screen.

3. The method of claim 2, further comprising adding coarse material that passes over the deck of the further dewatering screen to the coarse sand product.

4. The method of claim 2, further comprising:

collecting undersize material in the sump of the further dewatering screen, the undersize material comprising the fine fraction; and passing the undersize material, entrained in water, through a second fines separation stage, comprising one or more further hydrocyclones, before passing the undersize material onto the first dewatering screen.

5. The method of claim 1, wherein the first and second dewatering screens comprise first and second sides of a laterally divided split deck dewatering screen.

6. The method of claim 5, further comprising supplying the fine fraction of the feed material to a sump of the split deck dewatering screen, and pumping the fine fraction of the feed material, entrained in water, to the first fines separation stage.

7. The method of claim 5, further comprising adding a portion of the fine fraction from the first side of the split deck watering screen to the coarse sand product downstream of the split deck dewatering screen.

8. The method of claim 7, further comprising delivering the fine and coarse fractions from the respective first and second sides of the split deck dewatering screen onto a conveyor assembly comprising first and second conveyors being mounted adjacent the split deck dewatering screen for receiving material from a discharge end of respective sides thereof, the conveyor assembly being displaced along an axis extending transverse to the deck of the split deck dewatering screen to vary the proportion of material falling from each of the first and second sides of the split deck dewatering screen onto each of the first and second conveyors to thereby vary the amount of the fine fraction added to the coarse fraction to form the coarse sand product.

9. The method of claim 8, further comprising collecting a fine sand product from the first side of the split deck dewatering screen onto the first conveyor.

10. The method of claim 1, wherein first grading screen is adapted such that the fine fraction produced therefrom comprises sand having a particle size up to approximately 2 mm, the coarse fraction having a particle size greater than approximately 2 mm.

11. An apparatus for washing and grading sand, said apparatus comprising:

a first grading screen adapted to separate a feed material into a fine fraction and a coarse fraction, the coarse fraction having a greater particle size than the fine fraction, said first grading screen having an inclined deck comprising:

a first deck portion having apertures of a first size through which the fine fraction of the feed material, entrained in water, can pass to be collected in a first sump region;

a second deck portion, downstream of said first deck portion, through which the coarse fraction of the feed material, entrained in water, can pass to be collected in a second sump region;

wherein oversize waste material can pass over said first and second deck portions to be discharged from a distal end of said first grading screen;

a first fines separation stage comprising one or more hydrocyclones adapted to receive the fine fraction entrained in water, downstream of said first grading screen, to thereby remove fine contaminants;

a first dewatering screen having a deck adapted to dewater the fine fraction downstream of said first fines separation stage to provide a fine sand product; and a second dewatering screen having a deck adapted to dewater the coarse fraction downstream of said first grading screen to provide a coarse sand product.

12. The apparatus of claim 11, further comprising a further dewatering screen downstream of said first fines separation stage, said further dewatering screen having a deck with an aperture size selected to separate further coarse material from the fine fraction, the further coarse material passing over said deck of said further dewatering screen to be subsequently added to the coarse sand product.

13. The apparatus of claim 12, wherein said sump of said further dewatering screen includes or is associated with a pump adapted to pump the fine fraction, entrained in water, to a second fines separation stage, comprising one or more further hydrocyclones, upstream of said first dewatering screen.

14. The apparatus of claim 11, wherein said first and second dewatering screens comprise first and second sides of a laterally divided split deck dewatering screen.

15. The apparatus of claim 14, wherein the fine fraction of the feed material is supplied to a sump of said split deck dewatering screen, said sump including or being associated with a pump adapted to pump the fine fraction, entrained in water, to said first fines separation stage.

16. The apparatus of claim 14, wherein the fine and coarse fractions are delivered from the respective first and second sides of said split deck dewatering screen onto a conveyor assembly comprising first and second conveyors mounted adjacent said split deck dewatering screen to receive material from a discharge end of respective sides thereof, said conveyor assembly being displaceable along an axis extending transverse to said deck of said split deck dewatering screen to vary the proportion of material falling from each of said first and second sides of said split deck dewatering screen onto each of said first and second conveyors to thereby vary the amount of the fine fraction added to the coarse fraction to form the coarse sand product.

17. The apparatus of claim 16, wherein said first conveyor is adapted to collect a fine sand product from said first side of said split deck dewatering screen.

18. The apparatus of claim 11, wherein water and fine contamination overflowing from said upper ends of said hydrocyclones of said first fines separation stage is passed to a water treatment system to be treated and subsequently reused in said first grading screen and/or said first or second dewatering screens.

19. The apparatus of claim 18, wherein said water treatment system comprises a settling tank wherein sludge is collected in a lower end of said settling tank for subsequent removal, treatment and disposal, and water overflowing from said settling tank is collected in a water storage reservoir for subsequent reuse.

20. The apparatus of claim 19, further comprising a mixing and dosing apparatus adapted to add a flocculent to the waste water upstream of said settling tank.

* * * * *